United States Patent [19]

Clause, Jr. et al.

[11] Patent Number: 4,542,893

[45] Date of Patent: Sep. 24, 1985

[54] OVERLAPPING DOCUMENT STRIP CONVEYING METHOD AND APPARATUS

[75] Inventors: Marvin B. Clause, Jr.; Callie R. Thompson, both of Bethlehem, Pa.

[73] Assignee: Bell & Howell Company, Chicago, Ill.

[21] Appl. No.: 671,357

[22] Filed: Nov. 14, 1984

[51] Int. Cl.[4] ..... B65H 45/00; B65H 23/00; B65H 25/02

[52] U.S. Cl. ..... 270/52.5; 226/2; 226/28; 226/38; 226/45

[58] Field of Search ..... 270/41, 45, 51, 52.5, 270/58; 226/1-2, 8, 27-29, 38, 45

[56] References Cited

U.S. PATENT DOCUMENTS

| | | | |
|---|---|---|---|
| 3,556,509 | 1/1971 | Crum | 226/28 |
| 3,589,095 | 6/1971 | James et al. | 226/2 |
| 3,713,571 | 1/1973 | Simonton | 226/45 |
| 3,972,283 | 8/1976 | Jennings | 270/52.5 |
| 4,118,022 | 10/1978 | Rayfield et al. | 270/52.5 |
| 4,223,882 | 9/1980 | Stocker | 270/45 |
| 4,485,949 | 12/1984 | Gebhart | 226/45 |
| 4,502,676 | 3/1985 | Stocker | 270/45 |

FOREIGN PATENT DOCUMENTS

| | | | |
|---|---|---|---|
| 6600484 | 9/1966 | Netherlands | 270/52.5 |

*Primary Examiner*—E. H. Eickholt

*Attorney, Agent, or Firm*—Griffin, Branigan, & Butler

[57] ABSTRACT

An apparatus and method whereby two superposed strips (26, 28) of documents are conveyed in a direction of conveyance (30) toward a downstream workstation. The strips (26, 28) are conveyed over one another in a direction of superposition whereby the leading edges of documents of one strip alternate in sequence in the direction of conveyance with the leading edges of documents in the other strip. A determination and control (190) circuit determines whether the leading edges of documents in one strip are tending to creep up on the leading edges of documents in the other strip due to differing speeds of motion of the two strips. If a creeping condition is determined, the circuit (190) energizes brake (400) whereby the motion of at least one of the strips is at least temporarily retarded. The circuit (190) comprises a detector (188) for determining when leading ones of documents have been separated from their respective strips; timing pulse generator (200); counter selector (206) for selectively enabling a first counter (202) and a second counter (204) to count timing pulses (the counters (202, 204) being enabled in alternating fashion after documents are separated in alternating strip fashion from their strips); and, comparator (207) for comparing the counts in the two counters. The detector (188) detects leading edges and trailing edges of separated documents conveyed past it. The counters are enabled to count when the trailing edge of a preceding separated document is detected and are disabled when the leading edge of a just-separated document is detected. The control circuit (190) periodically deenergizes the brake for a time period extending from the time at which the leading edge of a just-separated document is detected until the time at which the trailing edge of the just-separated document is detected.

30 Claims, 5 Drawing Figures

OVERLAPPING DOCUMENT STRIP CONVEYING METHOD AND APPARATUS

BACKGROUND OF THE INVENTION

1. Field of the Invention

This invention pertains to document conveying methods and apparatus, and particularly to document conveying methods and apparatus wherein a plurality of superposed strips of documents are conveyed in a direction of conveyance toward a downstream workstation.

2. Prior Art and Other Considerations

U.S. Pat. No. 4,502,676, filed 31 Aug. 1981 by Stocker and incorporated herein by reference discloses a method of operating a document handling machine wherein two strips of documents are conveyed in a direction of conveyance. The two strips are conveyed one over the other in a direction of superposition which is essentially perpendicular to the direction of conveyance. Each of the strips comprises a plurality of documents, each of the documents having respective portions thereon which, upon eventual separation of the document from its strip, will be a leading edge and a trailing edge. Each of the documents belong to one of a plurality of groups of documents with documents in each group being related by a common intended packaging. The strips are conveyed one over the other in the direction of superposition whereby the trailing edges of documents of one strip alternate in sequence in the direction of conveyance with the trailing edges of documents in another strip. The strips are formatted and conveyed whereby during conveyance the trailing edges of all documents in a preceding group are encountered in the direction of conveyance before the trailing edges of documents in a following group are encountered. The term "shingling" is used herein to refer to the just-described method of conveying two superposed strips of documents.

In document handling machines which convey essentially uniformly sized documents in the manner described above it is desirable not only that the trailing edges of documents of a first strip alternate in sequence in the direction of conveyance with the trailing edges of documents in a second strip, but that the two strips be conveyed at essentially the same speed so as to maintain an essentially constant spacing along the direction of conveyance between the trailing edges of documents in the first strip and the trailing edges of documents in the second strip. Preferably the two strips are conveyed at essentially the same speed and in a manner whereby the trailing edges of documents in the second strip are essentially centered between the leading and trailing edges of a document in the first strip; i.e. the trailing edges of documents in the second strip occur essentially half way between the leading and trailing edges of a document in the first strip.

In the past it has been exceedingly difficult to insure that the two superposed strips of documents are conveyed in the direction of conveyance at essentially the same speed. For example, in embodiments wherein two superimposed trips are driven between two rollers comprising the drive mechanism, differing frictional forces affect the speeds of conveyance of the two strips. In such embodiments, a first coefficient of friction occurs between a first such roller and the first strip; a second coefficient of friction occurs between a second such roller and the second strip; and, a third coefficient of friction occurs between the superimposed (i.e. contacting) first and second strips. These three potentially different coefficients of friction tend to cause slippage between the strips, which alters the spacing between the corresponding edges of documents in the two strips.

If the desired constant spacing between the corresponding edges of documents in the two strips as described above is not maintained, then one strip may have a tendancy to "creep" up on the other. The creep may eventually occur to the extent that the corresponding edges of documents in the two strips are essentially aligned in the direction of superposition. Such alignment of leading edges causes problems when a downstream operation such as bursting, for example, is being performed in alternating strip fashion with respect to the documents in the two superposed strips. Alignment of the leading edges of documents in the two superposed strips can disrupt the bursting process and can confuse downstream document handling machinery (such as folders and collectors) regarding the proper sequence of documents to be handled thereby.

Heretofore one method of preventing alignment of the leading edges of documents in the two superposed strips was the essentially constant visual surveillance of the two conveyed strips. If the leading edges of documents in one strip began to creep up on the leading edges of documents in the other strip, the document handling machine was shut down so that the two strips could be repositioned relative to one another. The repositioning of the two strips was only a temporary preventative, however, in that the cause of the creep—the differing speeds of conveyance of the two strips—was not rectified.

In the above regard, in apparatus wherein the two strips are conveyed by power-driven roller-type mechanisms, causes of the differing speeds of conveyance of the two strips include the uneven wear of one or more rollers and the build up of dirt or the like on the rollers. Hence, in the prior art, efforts were made to keep the rollers clean and free from debris or the like that would influence the speed of strips conveyed by the rollers. These efforts were, for the most part, tedious and imprecise.

In view of the foregoing, it is an object of this invention to provide a document conveying method and apparatus wherein the conveyance of superposed strips of documents is controlled in a manner whereby the leading edges of documents in one strip are not prone to creep up on the leading edges of documents in the other strip.

An advantage of the present invention is the provision of a document conveying method and apparatus which automatically controls the relative speeds of conveyance of superposed strips of documents.

Another advantage of the present invention is the provision of a document conveying method and apparatus which effectively monitors the relative speeds of conveyance of superposed strips of documents.

Yet another advantage of the present invention is the provision of a document conveying method and apparatus wherein conveying speeds of superposed strips of documents are easily established upon apparatus start up.

Another advantage of the present invention is the provision of a document conveying method and apparatus which combats uneven wear of roller members comprising the apparatus.

Still another advantage of the present inventon is the provision of a document conveying method and apparatus which requires little operator supervision and surveillance.

SUMMARY

An apparatus and method are provided whereby two superposed strips of documents are conveyed in a direction of conveyance toward a downstream workstation. Each of the strips includes a plurality of documents which are eventually separated from their strips to have a leading edge and a trailing edge. The strips are conveyed over one another in a direction of superposition whereby the leading edges of documents of one strip alternate in sequence in the direction of conveyance with the leading edges of documents in the other strip.

A determination and control circuit is provided to determine whether the leading edges of documents in one strip are tending to creep up on the leading edges of documents in the other strip due to differing speeds of motion of the two superposed strips. If a creeping condition is determined by the circuit, the circuit energizes braking means whereby the motion of at least one of the strips is at least temporarily retarded for rectifying the creeping condition.

The braking means comprises a first brake for retarding the motion of a first of the strips and a second brake for retarding the motion of a second of the strips. The determination and control circuit selectively energizes either the first brake or the second brake to rectify the creeping condition. Each brake comprises a roller which contacts its respective strip and which is rotatable as the contacted strip moves across the roller. The roller is mounted on an intermediate portion of an axle which has a brake disc mounted near an end of the axle. The brake disc has a disc surface which is axially movable when attracted by a brake coil energized by the circuit. When the brake coil is energized, the disc surface contacts the coil whereby friction is created between the brake coil and the disc, thereby retarding the rotation of the axle and the roller mounted thereon. Retardation of the rotation of the roller increases the friction between the roller and its associated strip, thereby retarding the speed of the strip.

The determination and control circuit periodically permits the deenergization of the braking means, even when a creep condition is determined. In an embodiment wherein the braking means comprises rollers, the circuit periodically permits the rotational incrementation of the rollers, thereby precluding uneven wear of the rollers which might otherwise result if the brake were continuously applied.

The determination and control circuit comprises a detector for determining when leading ones of documents have been separated from their respective strips; timing pulse generation means; counter select means for selectively enabling a first counter and a second counter to count timing pulses (the counters being enabled in alternating fashion after documents are separated in alternating strip fashion from their strips); and, comparison means for comparing the counts in the two counters. The detector detects when leading edges and trailing edges of separated documents are conveyed past the detector. The counters are enabled to count when the trailing edge of a preceding separated document is detected and are disabled when the leading edge of a just-separated document is detected. The control circuit periodically deenergizes the braking means for a time period extending from the time at which the leading edge of a just-separated document is detected until the time at which the trailing edge of the just-separated document is detected, thereby precluding uneven wear of the braking means.

The control circuit further comprises brake energization timing means and brake energizing means responsively connected to the brake energization timing means. The brake energization timing means includes a multivibrator connected to the detector and to the comparison means.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention.

DETAILED DESCRIPTION OF THE DRAWINGS

Figure 1:
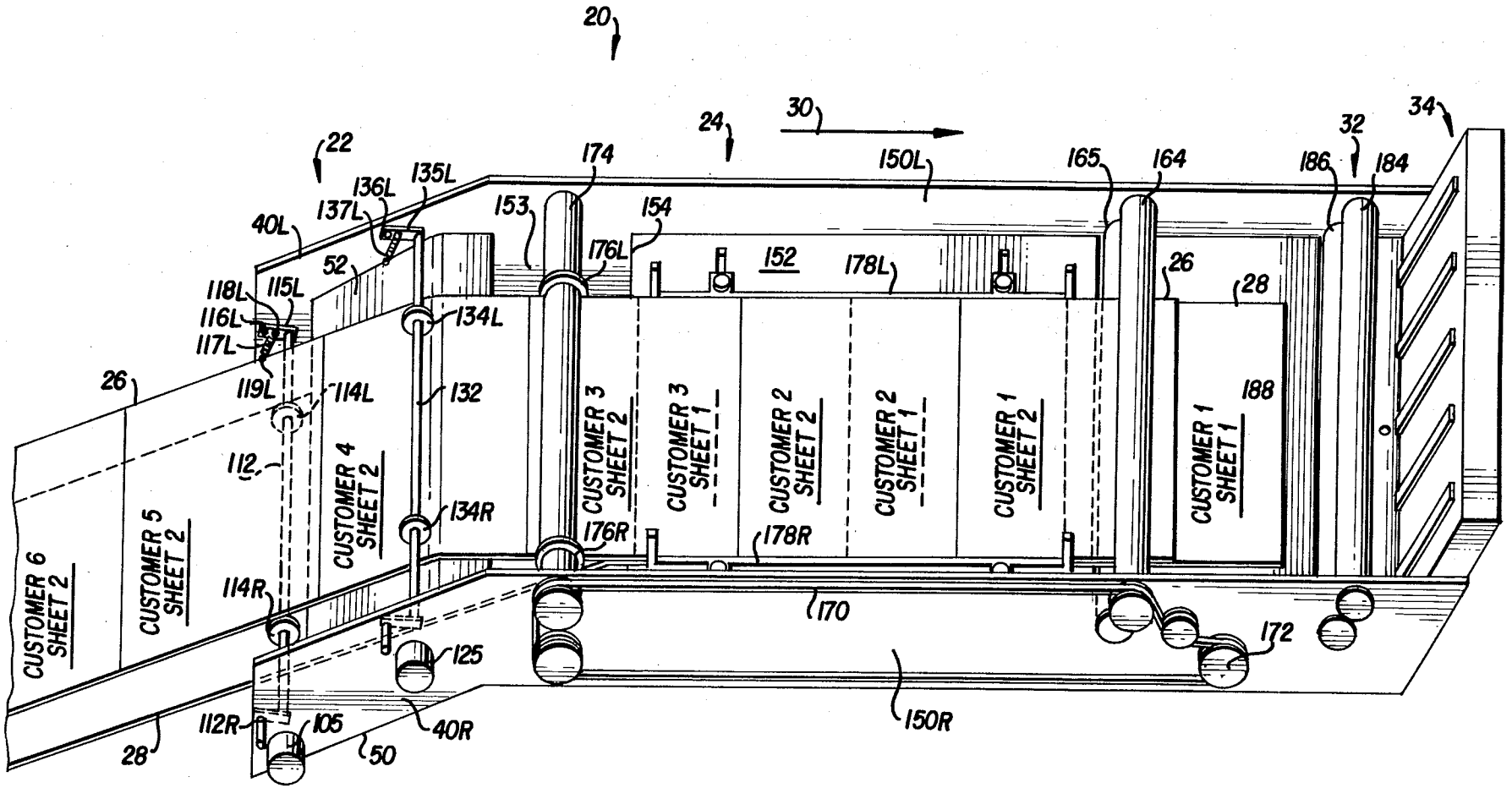
FIG. 1 is a perspective view as seen from above of document conveying apparatus in operation according to an embodiment of the invention.

FIG. 1 illustrates a document conveying apparatus 20 comprising an entrance port 22 and a horizontal conveyance table 24. As explained in more detail hereinafter, the conveying apparatus conveys two superposed webs or strips of documents, particularly an upper strip 26 and a lower strip 28, in a direction of conveyance as indicated by arrow 30. Each strip 26, 28 comprises a plurality of sheets which will be burst at perforated edges thereof. In this respect, for the illustration shown in FIG. 1, the strips 26 and 28 comprises sheets for a plurality of customers, each customer having a first sheet (on strip 28) and a second sheet (on strip 26). It should be understood that all customers need not have the same number of sheets as long as the strips 26, 28 are formatted and conveyed in the manner described by the incorporated Stocker U.S. Pat. No. 4,502,676.

Downstream from the document conveying apparatus and positioned to receive the strips 26, 28 are a plurality of serially arranged workstations, such as a burster 32 and a buckle folder 34. Although not illustrated in FIG. 1, it should be understood that an appropriate collector apparatus (such as that illustrated in the incorporated U.S. Pat. No. 4,502,676) can be positioned yet downstream from the buckle folder 34.

Figure 2:
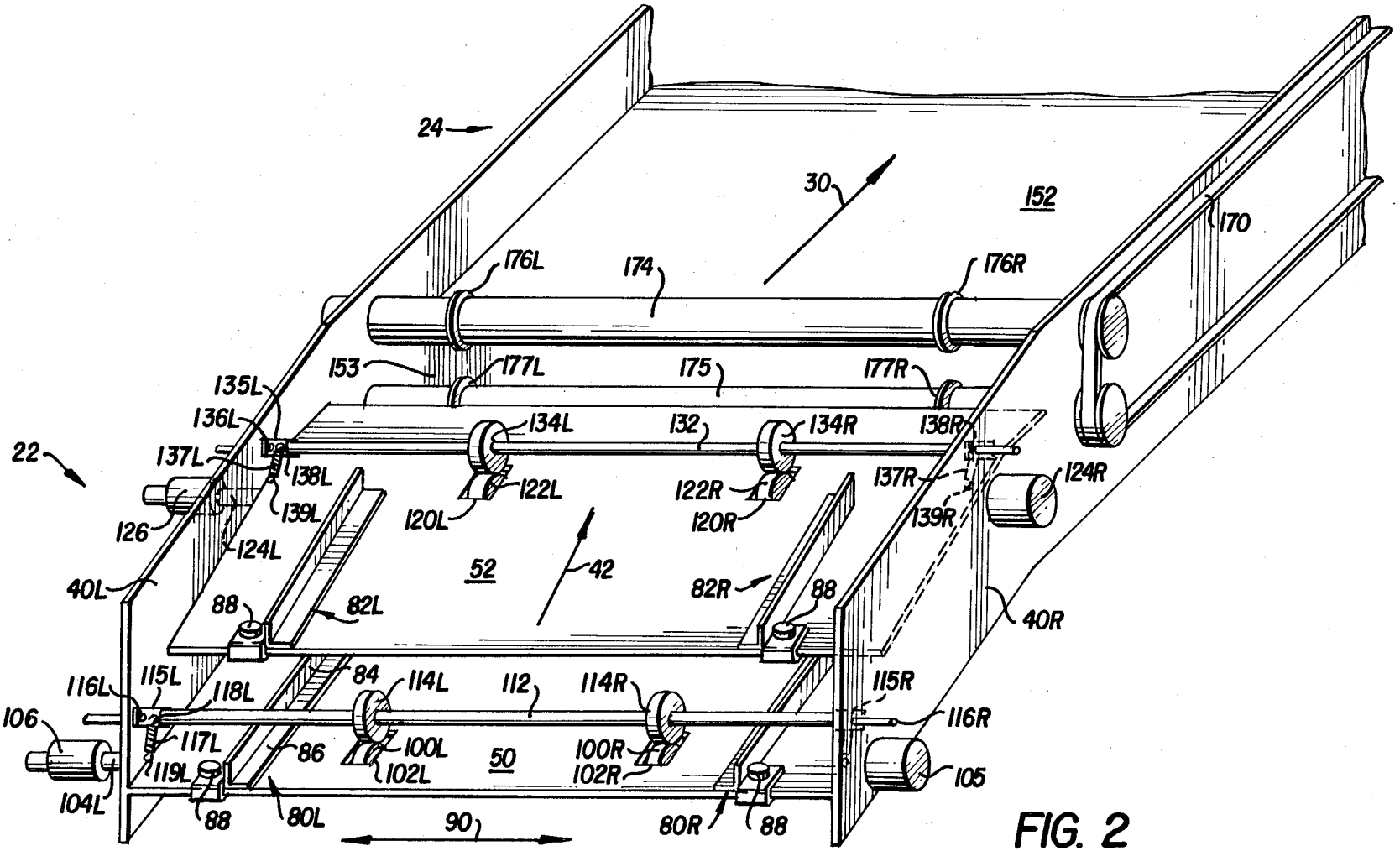
FIG. 2 is a perspective view as seen from one end of a portion of an idle document conveying apparatus according to the embodiment of FIG. 1.
Figure 3:
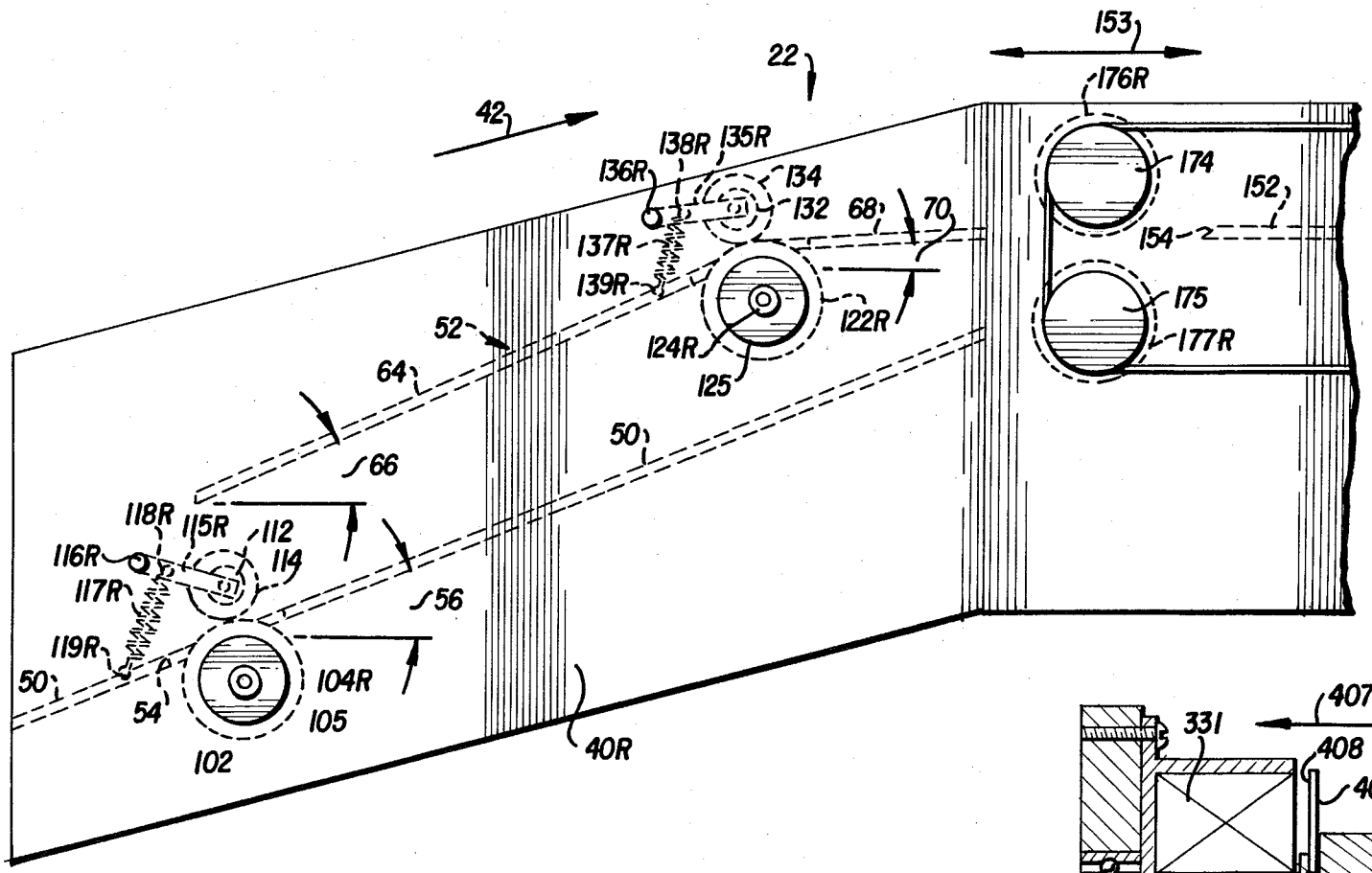
FIG. 3 is a side view of a portion of the document conveying apparatus of the embodiment of FIG. 1.

FIG. 2 illustrates the entrance port 22 in greater detail. The entrance port 22 comprises a frame having two opposing sidewalls 40L and 40R which, as seen in FIG. 3, are essential parallelogram-shaped and incline upwardly to ascend in the direction of strip feed as indicated by arrow 42. Extending between the two sidewalls 40L, 40R are a pair of input ramps, particularly a lower input ramp 50 and an upper input ramp 52.

Each of the ramps 50, 52 is inclined upwardly to ascend in the direction of strip feed as indicated by arrow 42. The lower ramp 50 has a ramping surface 54 which rises at an angle 56 relative to the horizontal (see FIG. 3). The upper input ramp comprises a first ramping surface 64 which rises at an angle 66 relative to the horizontal and an integral second ramping surface 68 which rises at an angle 70 relative to the horizontal (the angle 70 being much less than the angle 66). Along the direction 42 of strip feed the upper ramp 52 (including particularly the second ramping surface 68 thereof) and the lower ramp 50 extend essentially to the furtherest extremity of the entrance port sidewalls 40.

Each ramp 50, 52 has a set of adjustable strip guides positioned thereon. In this respect, guides 80L, 80R are provided on ramp 50; guides 82L, 82R are provided on the upper ramp 52. Depending on whether the guides 80, 82 have a leftward or rightward orientation, each guide has either an essentially L-shaped or backwards L-shaped configuration. Each guide 80, 82 comprises a standing leg 84 and a lying leg 86 as illustrated with reference to the guide 80L. The guides are maintained on their respective ramps by appropriate fastening means 88 whereby the distance between the guides in the direction of arrow 90 can be selectively adjusted.

Lower ramp 50 has two parallel slots 100L, 100R formed therein. Slots 100L, 100R are sized to expose the upper circumferential surfaces of corresponding lower drag rollers 102L, 102R. The drag rollers 102L, 102R are mounted on an axle 104 which extends through bushing/bearing structures in sidewalls 40L, 40R and which protrude beyond sidewalls at axle ends 104L, 104R. At axle end 104L a manual adjustment handle 106 is formed. Sidewall 40 has a lower brake housing 105 secured thereto which surrounds axle end 104R.

Extending between the sidewalls 40 and at an altitude above the lower ramp 50 but below the upper ramp 52 is a shaft 112. Shaft 112 has idle drag drop rollers 114L, 114R, positioned thereon. The drop rollers 114L, 114 have central bearings therein whereby rollers 114L, 114R rotate about the axis of shaft 112. The lower circumferential surfaces of drag rollers 114L, 114R are in nipping relationship to the upper circumferential surfaces of the corresponding drag rollers 102L, 102R. The left and right ends of shaft 112 are connected to first ends of corresponding brackets 115L and 115R. Second ends of brackets 115L and 115R are connected to pivot points comprising respective pivot shafts 116L and 116R. Pivot shafts 116L and 116R each extend through unillustrated bushing/bearing arrangements in respective sidewalls 40L, 40R. A helical tension spring 117 having hooked opposing ends serves to bias shaft 112 and rollers 114L, 114R thereon toward rollers 102L and 102R. In this regard, a first hooked end of spring 117 engages a pin 118 on bracket 115 while a second hooked end of spring 117 engages a pin 119 on the interior of the sidewall 40.

In much the same manner as lower ramp 50 is provided with slots 100L, 100R; drag rollers 102L, 102R; axle 104; shaft 112; drag rollers 114L, 114R; brackets 115L, 115R; pivot shafts 116L, 116R; and tension springs 117L, 117R; the upper ramp 52 has associated therewith analogous structure including parallel slots 120L, 120R; drag rollers 122L, 122R; axle 124 (provided with manual adjustment handle 126 at axle end 124L and axle end 124R being surrounded by an upper brake housing 125 secured to sidewall 40R); shaft 132; drop rollers 134L, 134R; brackets 135L, 135R; pivot shafts 136L, 136R; and, tension springs 137L, 137R engaging pairs of pins 138L, 139L.

The horizontal conveyance table 24 comprises parallel sidewalls 150L, 150R and an essentially horizontal conveying surface 152. The horizontal conveying surface 152 is recessed away from the input end of the conveyance table 24 so that a gap 153 exists between the entrance port 22 and the leading edge of the horizontal conveying surface 152. The leading edge 154 of surface 152 is positioned whereby the lower strip 28 documents bridge the gap 153 from lower input ramp 50 to the conveying surface 152. As seen hereinafter, the lower strip 28 of documents is conveyed along conveying surface 152 in the direction of arrow 30. The upper strip 26 of documents bridges the gap from the upper input ramp 52, and particularly the upper second ramping surface 68 thereof, to the conveying surface 152 whereby the upper strip 26 is positioned in superimposed relationship above the lower strip 28. The upper strip 26 of documents is likewise conveyed along conveying surface 152 in the direction of arrow 30.

The horizontal conveyance table 24 also has a pair of driven rollers 164, 165 which cooperate to impart motion to the superimposed strips 26 and 28 which are engaged between the rollers 164, 165. Rollers 164, 165 are driven by driving means including a driving belt 170 which cooperates with driving shaft 172 to rotate the rollers 164, 165 so that the strips 26, 28 are conveyed in the direction of arrow 30.

In the region of the gap 153 the horizontal conveyance table 24 is provided With upper and lower rotatable cutter shafts 174 and 175, respectively. The cutter shafts 174, 175 have circular cutter blades 176, 177 respectively mounted thereon for trimming perforated margins from document strips. Although not illustrated as such, it should be understood that for safety reasons the cutter blades 176, 177 may be at least partially enclosed in appropriate housings.

The horizontal conveying surface 152 has left and right guides 178L, 178R thereon. Guides 178L, 178R are adjustably positionable and basically resemble the guides provided on the entrance port 22.

The burster 32 is of an conventional type well known in the prior art. The burster comprises two essentially cylindrical rollers such as upper roller 184 and lower roller 186. The roller 184 is driven (by means not shown) in the counter-clockwise direction while the roller 186 is driven (by means not shown) in the clockwise direction, both rollers 184 and 186 being driven to have a greater angular velocity than the rollers 164, 165. Leading edges of documents are engaged between the burster rollers 184, 186 and separated or "burst" from their strip at their trailing edge perforations.

Figure 4:
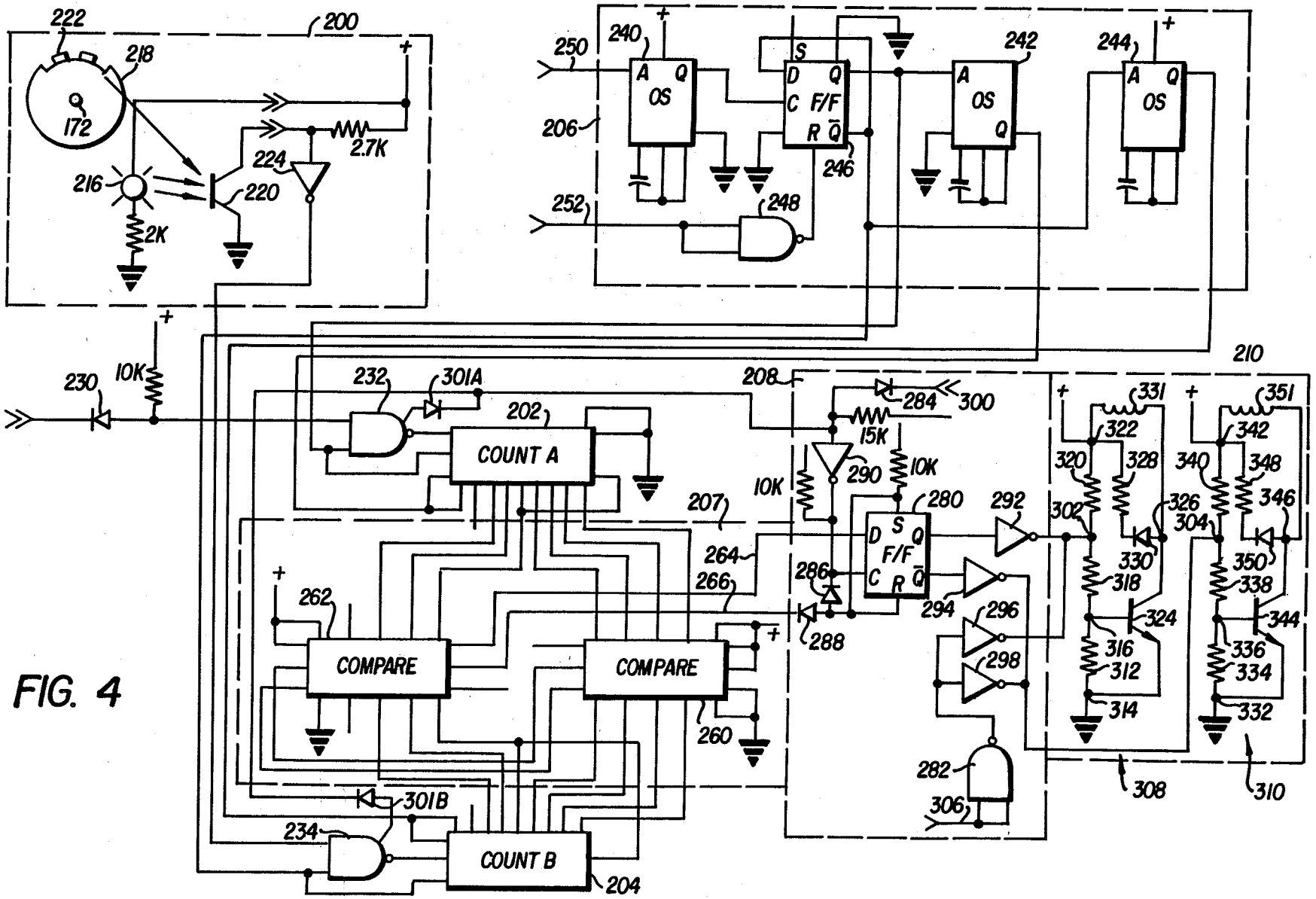
FIG. 4 is a schematic view of opto-electrical circuitry associated with the document conveying apparatus of the embodiment of FIG. 1; and, FIG. 5 is a partial cross-sectional view of braking means for the document conveying apparatus of the embodiment of FIG. 1.

Positioned in the plane of the horizontal conveying table 152 (and looking upwardly essentially immediately after the burster 32) is detection means, particularly burster photocell 188, which is included in a determination and control circuit 190 shown in more detail in FIG. 4.

FIG. 4 shows the determination and control circuit 190. The determination and control circuit 190 comprises timing pulse generation means (framed by the broken line 200); first counter means 202, also known as counter A; second counter means 204, also known as counter B; counter select means (framed by the broken line 206); comparison means (framed by the broken line 207); brake energization timing means (framed by the broken line 208); and, brake energizing means (framed by broken line 210).

The timing pulse generation means 200 includes a photo-interrupter comprising a photocell 216; an interrupter disc 218; and, a phototransistor 220. The interrupter disc is mounted on a rotating shaft such as driving shaft 172 in a manner whereby light from photocell 216 shining on phototransistor 220 is periodically interrupted by teeth 222 on the interrupter disc 218. In the disclosed embodiment, 36 such teeth are provided on the interrupter disc 218. Phototransistor 220 is connected to the input terminal of an inverting driver 224. The leading edge of a timing pulse occurs at the output terminal of inverting driver 224 whenever light from photocell 216 is interrupted by a tooth 222 on the interrupter disc 218.

The output terminal of the inverting driver 224 is connected to the anode of diode 230; to a positive voltage potential through a 10K resistor; to a first input terminal of a NAND gate 232; and, to a first input terminal of a NAND gate 234. The cathode of diode 230 is connected to a single page switch (SPS) positioned on an unillustrated operator's console.

The counter select means 206 comprises a plurality of multi-vibrator means, such as one-shots 240, 242, and 244; a dual "D" flip-flop 246; and, NAND gate 248. Input terminal A of one-shot 240 is connected by line 250 to an unillustrated phototransistor associated with the photocell 188. The clock input pin of flip-flop 246 is connected to the Q output terminal of the one-shot 240. The Q output terminal of flip-flop 246 is connected to input terminal A of one-shot 242; to the second input terminal of NAND 232; and, to the count enable pin (pin 2) of first counter 202. Likewise, output terminal $\overline{Q}$ of flip-flop 246 is connected to output terminal A of one-shot 244; the second input terminal of NAND 234; and, the count enable pin (pin 2) of the second counter 204. The "D" data input pin of flip-flop 246 is tied to its $\overline{Q}$ output terminal. The reset terminal of flip-flop 246 is connected to the output terminal of NAND 248. The input terminals of NAND 248 are tied together and connected by a line 252 to the unillustrated "single page" switch (SPS) on the previously-referenced operator's console.

The first counter 202 has its clock input pin connected to the inverting output terminal of NAND 232; its count enable terminal (pin 2) connected to the Q output terminal of flip-flop 246; and, its reset terminals (pins 7 and 15) tied together and connected to the Q output terminal of one-shot 242. Likewise, the second counter 204 has its clock input terminal (pin 1) connected to the inverting output terminal of the NAND 234; its count enable input terminal (pin 2) connected to the $\overline{Q}$ output terminal of flip-flop 246; and, its reset terminals (pins 7 and 15) tied together and connected to the Q output terminal of one-shot 244. The data output terminals of the counters 202 and 204 are connected to the comparison means 207 in the manner described hereinafter.

The comparison means 207 comprises a dual synchronous decade counter comprising two counter chips 260 and 262. The data output terminals of the first counter 202 are connected to a first bank of input terminals comprising pins 14, 12, and 3 on chip 262 and pins 1, 3, 12, and 14 on chip 260. Similarly, the data output terminals of the second counter 204 are connected to a second bank of input pins comprising pins 2, 4, 13, and 15 on chip 260 and pins 15, 13, and 4 on chip 262.

The "A less than B" output terminal of chip 262 and the "A equal to B" output terminal of chip 262 are connected by respective lines 264 and 266 to the brake energization timing means 208 in the manner hereinafter described.

The brake energization timing means 208 comprises "D"-type flip-flop 280; NAND gate 282; diodes 284, 286, and 288; and, inverting drivers 290, 292, 294, 296, and 298.

An unillustrated phototransistor associated with the photocell 188 is connected by line 300 to the cathode of diode 284. The anode of diode 284 is connected to a positive potential through a 1.5K resistor; to the cathodes of diodes 301A and 301B; and, to the input terminal of the inverting driver 290. The output terminal of the inverting driver 290 is connected through a 10K resistor to a positive potential; to the clock input terminal of the flip-flop 280; and, to the cathode of diode 286. The anode of diode 286 is connected to the set and reset terminals of the flip-flop 280 and to the anode of the diode 288. The anode of diode 288 is likewise connected to both the set and reset terminals of flip-flop 280 and through a 10K resistor to a positive voltage. The cathode of diode 288 is connected to the line 266 which, as described before, connects to the "A equal to B" output terminal of the chip 262 included in the comparison means 207.

The "D" input terminal of flip-flop 280 is connected by line 264 which, as described before, is connected to the "A less than B" output terminal of chip 262 included in the comparison means 207. The Q output terminal of flip-flop 280 is connected to the input terminal of the inverting driver 292, while the $\overline{Q}$ output terminal of the flip-flop 280 is connected to the input terminal of the inverting driver 294. The output terminal of inverting driver 292 is connected to a point 302 on a first voltage division network in the brake energizing means 210, while the output terminal of the inverting driver 294 is connected to a point 304 in a second voltage division network in the brake energizing means 210.

The NAND gate 282 included in the brake energization timing means 208 has its two input terminals tied together and connected by a line 306 to the unillustrated phototransistor associated with the photocell 188.

The output terminal of NAND 282 is connected to input terminals of the inverting drivers 296 and 298. The output terminal of the inverting driver 296 is connected to point 302, while the output terminal of the inverting driver 298 is connected to the point 304.

The brake energizing means includes a lower brake energizing circuit 308 and an upper brake energizing circuit 310, each brake energizing circuit having its own voltage division network. The first voltage division network comprises a resistor 312 connected between point 314 (ground) and point 316; a resistor 318 connected between points 316 and point 302; and, a resistor 320 connected between point 302 and point 322 (+30 volts DC). An NPN transistor 324 has its emitter connected to point 314; its base connected to point 316, and its collector connected to point 326. Points 322 and 326 are connected by series combination of a resistor 328 and a diode 330. Moreover, a lower brake coil 331 is connected between points 322 and 326.

The second voltage division newtwork of brake energizing means 210 comprises a point 332 (ground); a resistor 334 connected between point 332 and a point 336; a resistor 338 connected between points 336 and 304; and, a resistor 340 connected between points 304 and 342 (+30 volts DC). An NPN transistor 344 has its emitter connected to point 332; its base connected to point 336; and, its collector connected to point 346. Points 342 and 346 are connected by the series combination of a resistor 348 and a diode 350. Moreover, an upper brake coil 351 is connected between points 342 and 346.

Figure 5:
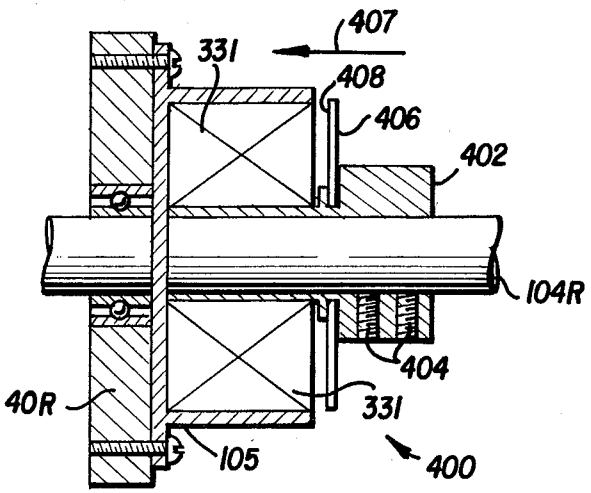

The lower brake coil 331 comprises a lower brake unit 400 as seen in FIG. 5. The lower brake unit 400 further comprises a hub 402 securely mounted on shaft end 104R by fasteners 404. An axially displacable disc 406 has a brake surface 408 which is magnetically attractable whereby disc 406 moves in the direction of arrow 407 and contacts coil 331 when coil 331 is energized. When coil 331 is energized, disc surface 408 is attracted to contact coil 331. When in contacting relationship, the coil 331 creates a drag on disc 408, and hence slows the speed of shaft 104 and rollers 102 mounted thereon. Disc 406 rotates with hub 402 since it is in toothed engagement with the hub 402. Coil 331 is connected by wires 408 and 409 to points 322 and 326 in the circuit of FIG. 4.

The upper brake coil 351 likewise comprises an upper brake unit which resembles the lower brake unit 400. It should be understood that the upper brake unit includes a comparable hub and disc arrangement as that described above including a disc which is magnetically attractable axially along shaft 124 toward contacting relationship with coil 351.

In operation, to set up the document conveying apparatus 20 the two strips 26 and 28 are manually pulled through entrance port 22 onto the horizontal conveyance table 24. In this respect, strip 28 is first manually pulled over lower ramp 50 between guides 80L, 80R; pulled between drop rollers 114 and idle rollers 102; pulled across gap 153; pulled onto conveying surface 152; and, engaged between rollers 164 and 165. When strip 28 is nipped between rollers 164 and 165, the single page switch (SPS) on the operator's control console is pressed for a first time. Pressing the SPS this first time causes rollers 164 and 165 to briefly rotate to pull strip 28 further in the direction of arrow 30. In this respect, pressing the SPS causes drive shaft 172 to briefly rotate, as well as rollers 164 and 165 coupled to drive shaft 172 by transmission belt 170. As strip 28 is pulled across the conveying surface 152, drop rollers 114 and idle rollers 102, having strip 28 engaged therebetween, are caused to rotate.

In much the same fashion, strip 26 is manually pulled over upper ramp 52 between guides 82, 82R; pulled between drop rollers 134 and idle rollers 122; pulled across gap 153; pulled onto conveying surface 152 (traveling over strip 28); and, engaged between rollers 164 and 165. When strip 26 is nipped between rollers 164 and 165, the SPS is pressed for a second time to again cause rollers 164 and 165 to briefly rotate, thereby pulling strip 26 further in the direction of arrow 30 and advancing strip 28 even further in the same direction. As strip 26 is pulled across conveying surface 152, drop rollers 134 and idle rollers 122, having strip 26 engaged therebetween, are caused to rotate.

As a result of the foregoing operation the lead edge of the first sheet of lower strip 28 precedes in the direction of the arrow 30 the lead edge of strip 26 by a predetermined distance which is about one-half the length of a sheet on strip 26. In this respect, the length of a sheet or document as referred to herein is the dimension of a sheet from its eventual leading edge to its eventually trailing edge (i.e. the dimension parallel to the direction of arrow 30). For example, if with respect to the direction 30 the distance between the leading edge and trailing edge of each sheet were eight inches, the leading edge of the first sheet on strip 28 (hereinafter known as the first customer's first sheet) preceeds the leading edge of the first document on strip 26 (hereinafter referred to as the first customer's second sheet) by four inches.

When the lead edges of strips 28 and 26 are positioned as described above, the operator for a third time presses the SPS. Pressing the SPS this third time again causes the brief rotation of the rollers 164 and 165. As rollers 164 and 165 rotate, the superimposed strips 26 and 28 are conveyed in the shingled manner in the direction of arrow 30. Moreover, with the SPS closed, timing pulses appear at the output port of driver 224 in accordance with the periodic interruption of photocell 216 by teeth 220 as interrupter disc 218 rotates. Further, the closing of the SPS puts a true signal on line 252, causing the output of NAND 248 to go true and thereby reset flip-flop 246. Resetting flip-flop 246 serves to (1) trigger one-shot 244 to reset counter 204; (2) enable counter 204 to count; and, (3) enable NAND 234 to gate timing pulses to the input terminal (pin 1) of counter 204.

The current count in now-counting counter 204 is available at its data output pins and is applied to comparator 207. It will be appreciated that upon start-up the count for the first customer's first sheet in counter A will always exceed the count in counter B, so that the "A less than B" ouput terminal of chip 262 and the signal on line 264 to flip-flop 288 remains false.

As the first customer's first sheet is engaged between the faster rotating burster rollers 184 and 186, the first customer's first sheet is separated or "burst" from the strip 28. Upon bursting, the leading edge of the first customer's first sheet interrupts the photocell 188.

Interruption of the "burst" photocell 188 results in false signals being applied both on lines 300 and 306. The false signal on line 306 ultimately precludes energization of both the lower brake coil 331 and the upper brake coil 351 while the burst photocell 188 is covered by a sheet. Thus, when the burst photocell 188 is covered the lower idle rollers 102 and the upper idle rollers 122 are free to be rotationally incremented by the drag created by the movement of respective strips 28 and 26. In this regard, the false signal on line 306 causes a true output signal from NAND 282. The true output signal of NAND is inverted by drivers 296 and 298 to a false signal. False signals at points 302 and 304 turn off the respective transistors 324 and 344, and thus deenergize respective coils 331 and 351. With coils 331 and 351 deenergized, the braking discs in the respective braking units are not magnetically attracted to their respective coils, thereby permitting shafts 104 and 114, and hence rollers 102 and 122, to be rotationally incremented by the drag created by strips 26 and 28.

The false signal on line 300 occasioned by the covering of burst photocell 188 by the leading edge of a sheet is inverted by driver 284 whereby a true signal is applied to the clock input of flip-flop 280. At this point the false signal appearing on line 264 to the "D" input terminal of flip-flop 280 causes the $\overline{Q}$ output pin to go true and the Q output pin to go false.

Due to the false signal on line 306 and the false signals at points 302 and 304, the signals at the output pins of flip-flop 280 have no effect upon the transistors 324 and 344 and the respective brake coils 331, 351 until the burst photocell 188 is uncovered. In this regard, when the trailing edge of the first customer's first sheet uncovers the burst photocell 188 the signal on line 306 goes true to ultimately cause drivers 296 and 298 to output true signals. Thus, when the trailing edge of a sheet uncovers the photocell 188, the output signals at pins Q and $\overline{Q}$ of flip-flop 280 become effective to energize or deenergize the brake coils 331 and 351. Considering the uncovering of the photocell 188 by the first customer's first sheet, the false signal at the Q output terminal of flip-flop 280 is inverted (by driver 292) to turn on NPN transistor 324 and thereby energize the lower brake coil 331. The true signal at the $\overline{Q}$ output terminal of flip-flop 280 is inverted (by driver 294) to turn off the NPN transistor 344 and thus deenergize the upper brake coil 351.

Energization of lower brake coil 331 causes coil 331 to magnetically attract the disc 406. In this respect, disc 406 moves axially in the direction of arrow 407, bringing brake surface 408 into contact with coil 331. The increased drag occasioned by the friction between coil 331 and brake surface 408 is transmitted through hub 402, shaft 104, and rollers 102 resulting in an increased drag on the strip 28 as rollers 164 and 165 pull strip 28 in the direction of arrow 30. Soon after bursting of the first customer's first sheet, however, the rollers 164 and 165 are deactivated unless a "start" switch on the operator's console has been closed. For reasons related to the operation of downstream collector structure as disclosed in the incorporated Stocker patent application, this "start" switch is usually not closed until after the first customer's first sheet has been burst. Once the "start" switch is closed, the rollers 164, 165 are caused to rotate on a substantially continuous basis until a given job is completed.

When the "start" switch is closed, rollers 164 and 165 are caused to rotate substantially continuously, pulling strips 26 and 28 further in the direction of arrow 30.

The leading edge of strip 26 is now preceeding the leading edge of strip 28, since the first customer's first sheet (which was on strip 28) has just been burst.

When the trailing edge of the first customer's first sheet uncovered photocell 188, the signal on line 250 went true. A true signal on line 250 caused one-shot 240 to trigger flip-flop 246 so that the true output of flip-flop 246 switched to the Q output terminal. A true signal at the Q output terminal of flip-flop 246 serves to (1) trigger one-shot 242 to reset counter 202; (2) enable counter 202 to count; and, (3) enable NAND 232 to gate timing pulses to the clock input terminal (pin 1) of counter 202. Counter 202 counts the timing pulses that it receives from the pulse generation means 200.

The count in counter 202 for the first customer's second sheet is compared by the comparison means 207 to the count stored in counter 204 for the first customer's first sheet. After the first customer's second sheet is burst, its leading edge covers the photocell 188. When the leading edge of the first customer's second sheet covers the photocell 188, the signal on line 300 goes false and is inverted to apply a true signal at the clock input pin of flip-flop 280. Flip-flop 280 then clocks in whatever signal is on line 264. Because the lower brake coil 331 was energized after bursting of the first customer's first sheet, it is generally expected that upon bursting of the first customer's second sheet that the count in counter A will be less than the count in counter B. If this is so, then a true signal on line 264 is clocked through flip-flop 280. A true signal being clocked to flip-flop 280 causes output pin Q to go true, and output $\overline{Q}$ to go false. While the first customer's second sheet covers the photocell 188, both transistor 324 and 344 are deenergized, and the respective brake coils 331 and 351 are turned off. When the trailing edge of the first customer's second sheet uncovers the photocell 188, the true signal at output pin Q is inverted (by driver 292) to turn off the PNP transistor 324 and thus the lower brake coil 331. The false signal at output terminal $\overline{Q}$ of flip-flop 280 is inverted (by driver 294) to turn on the NPN transistor 344 and thereby energize the upper brake coil 351. When energized the upper brake coil 351 attracts and is contacted by the braking surface of the brake disc in housing 125. In the same manner as described before with respect to the operation of the lower brake unit 400, the increased drag occasioned by the friction between coil 351 and the brake disc is transmitted through shaft 124 and rollers 122 thereon, resulting in a greater drag on the strip 26 being pulled by rollers 164, 165. The increased drag on strip 26 continues until the next sheet is burst.

As the rollers 164, 165 continue to rotate and impart motion to the strips 26 and 28, sheets are bursting in alternating fashion from the strips 26 and 28. As each burst sheet interrupts the burst photocell 188, the signal then appearing on line 264 to the "D" input terminal of flip-flop 280 is clocked through the flip-flop 280. As long as the burst sheet covers the photocell 188, the brake coils 331 and 351 are deenergized to allow the brief rotational incrementation of the rollers 102 and 122, thereby preventing flat spots from developing on the rollers 102 and 122. As soon as the burst document uncovers the photocell 188, the signals at the output pins of flip-flop 280 become effective to either energize or deenergize the brake coils 331, 335. As noted above, if a true signal appears at the Q output pin of flip-flop 280, the upper brake coil 351 is energized and the lower brake coil 331 is deenergized. If a true signal appears at the $\overline{Q}$ output pin of flip-flop 280, the lower brake coil 331 is energized and the upper brake coil 351 is deenergized. If, upon the covering of burst photocell 188 the signal on line 266 is true (meaning that the counts in counters A and B are equal), true signals are applied to both the set and reset terminals of flip-flop 280. When flip-flop 280 is both set and reset, true signals appear at both the Q and $\overline{Q}$ output pins to effectively turn off both brake coils 331, 351 since neither is needed in view of the equal speeds of travel of the strips 26 and 28.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. Apparatus for conveying at least two superposed strips of documents in a direction of conveyance toward a downstream workstation, each of said strips comprising a plurality of documents, each of said documents having a portion thereof which will be a leading edge upon eventual separation of said document from its strip, said strips being conveyed over one another in a direction of superposition whereby the leading edges of documents of one strip alternate in sequence in the direction of conveyance with the leading edge of documents in another strip, said apparatus comprising:

conveying means for imparting motion to said strips in said direction of conveyance;

separating means for separating in alternating strip fashion leading ones of said document from their respective strips;

means for determining whether the leading edges of documents in one of said strips are in an acceptable positional relationship in said direction of conveyance with said leading edges of documents in the other of said strips, said determining means further comprising:

means for determining when leading ones of said documents have been separated from their respective strips and for generating a separation signal indicative thereof;

means for generating timing pulses;

first counter means;

second counter means;

counter select means for selectively enabling counting of said timing pulses by said first counter and said second counter, said counters being enabled in alternating fashion after documents are separated in alternating strip fashion from their strips, said counters being enabled to count the number of pulses generated from a point in time after a preceding document has been separated from a first of said strips until a document has been separated from a second of said strips; and, means for comparing the count in one of said counters (indicative of the number of timing pulses generated with respect to the conveyance of a just-separated from said second strip document) with the count in the other of said counters (indicative of the number of timing pulses generated with respect to the conveyance of the document previously separated from said first strip) and for generating a comparison signal indicative thereof;

braking means capable of at least temporarily retarding the motion of at least one of said strips; and, control means responsive to said determining means for controlling said braking means whereby the motion of at least one of said strips is retarded for urging the leading edges of documents in one of said strips into said acceptable positional relationship in said direction of conveyance with the leading edges of documents in the other of said strips.

2. The apparatus of claim 1, wherein said control means comprises:

brake energization timing means responsive to said separation signal and said comparison signal; and, brake energizing means responsively connected to said brake energization timing means.

3. The apparatus of claim 2, wherein said brake energization timing means comprises multivibrator means connected to said detection means and to said comparison means whereby said separation signal is used to clock said comparison signal to said brake energizing means.

4. The apparatus of claim 2, wherein said brake energizing means comprises an electrical brake coil energizable in response to said brake energization timing means.

5. The apparatus of claim 2, wherein said braking means comprises a first brake for retarding the motion of a first of said strips and a second brake for retarding the motion of a second of said strips, wherein said brake energizing means comprises a first electrical brake coil associated with said first brake and a second electrical brake coil associated with said second brake, and wherein an output signal from said brake energization timing means determines which of said brake coils are to be energized.

6. The apparatus of claim 5, wherein said control means periodically deenergizes both said first brake and said second brake.

7. The apparatus of claim 1, wherein said means for determining when leading ones of said documents have been separated from their respective strips comprises detection means for detecting when leading edges and trailing edges of separated documents are conveyed past said detection means.

8. The apparatus of claim 7, wherein said point in time whereat said counters are enabled to count is the time whereat said detection means detects the trailing edge of the preceding separated document and the time whereat said counters are disabled is the time whereat the leading edge of a just-separated document is detected by said detection means.

9. The apparatus of claim 7, wherein said control means deenergizes said braking means for a time period extending from the time whereat said detection means detects the leading edge of a just-separated document to the time whereat said detection means detects the trailing edge of said just-separated document, thereby precluding uneven wear of said braking means.

10. The apparatus of claim 1, wherein said control means periodically deenergizes said braking means, thereby precluding uneven wear of said braking means.

11. Apparatus for conveying at least two superposed strips of documents in a direction of conveyance toward a downstream workstation, each of said strips comprising a plurality of documents, each of said documents having a portion thereof which will be a leading edge upon eventual separation of said document from its strip, said strips being conveyed over one another in a direction of superposition whereby the leading edges of documents of one strip alternate in sequence in the direction of conveyance with the leading edge of documents in another strip, said apparatus comprising:

conveying means for imparting motion to said strips in said direction of conveyance;

separating means for separating in alternating strip fashion leading ones of said document from their respective strips;

means for determining whether the speeds of motion of said strips are in an acceptable velocity relationship, said determining means further comprising:

means for determining when leading ones of said documents have been separated from their respective strips and for generating a separation signal indicative thereof;

means for generating timing pulses;

first counter means;

second counter means;

counter select means for selectively enabling counting of said timing pulses by said first counter and said second counter, said counters being enabled in alternating fashion after documents are separated in alternating strip fashion from their strips, said counters being enabled to count the number of pulses generated from a point in time after a preceding document has been separated from a first of said strips until a document has been separated from a second of said strips; and, means for comparing the count in one of said counters (indicative of the number of timing pulses generated with respect to the conveyance of a just-separated from said second strip document) with the count in the other of said counters (indicative of the number of timing pulses generated with respect to the conveyance of the document previously separated from said first strip) and for generating a comparison signal indicative thereof;

braking means capable of at least temporarily retarding the motion of at least one of said strips; and, control means responsive to said determining means for controlling said braking means whereby the motion of at least one of said strips is retarded for restoring said acceptable velocity relationship of said strips.

12. The apparatus of claim 11, wherein said control means comprises:

brake energization timing means responsive to said separation signal and said comparison signal; and, brake energizing means responsively connected to said brake energization timing means.

13. The apparatus of claim 12, wherein said brake energization timing means comprises multivibrator means connected to said detection means and to said comparison means whereby said separation signal is used to clock said comparison signal to said brake energizing means.

14. The apparatus of claim 12, wherein said brake energizing means comprises an electrical brake coil energizable in response to said brake energization timing means.

15. The apparatus of claim 12, wherein said braking means comprises a first brake for retarding the motion of a first of said strips and a second brake for retarding the motion of a second of said strips, wherein said brake energizing means comprises a first electrical brake coil associated with said first brake and a second electrical brake coil associated with said second brake, and wherein an output signal from said brake energization timing means determines which of said brake coils are to be energized.

16. The apparatus of claim 15, wherein said control means periodically deenergizes both said first brake and said second brake.

17. The apparatus of claim 11, wherein said means for determining when leading ones of said documents have been separated from their respective strips comprises detection means for detecting when leading edges and trailing edges of separated documents are conveyed past said detection means.

18. The apparatus of claim 17, wherein said point in time whereat said counters are enabled to count is the time whereat said detection means detects the trailing edge of the preceding separated document and the time whereat said counters are disabled is the time whereat the leading edge of a just-separated document is detected by said detection means.

19. The apparatus of claim 17, wherein said control means deenergizes said braking means for a time period extending from the time whereat said detection means detects the leading edge of a just-separated document to the time whereat said detection means detects the trailing edge of said just-separated document, thereby precluding uneven wear of said braking means.

20. The apparatus of claim 11, wherein said control means periodically deenergizes said braking means, thereby precluding uneven wear of said braking means.

21. A method for conveying at least two superposed strips of documents in a direction of conveyance toward a downstream workstation, each of said strips comprising a plurality of documents, each of said documents having a portion thereof which will be a leading edge upon eventual separation of said document from its strip, said strips being conveyed over one another in a direction of superposition whereby the leading edges of documents of one strip alternate in sequence in the direction of conveyance with the leading edge of documents in another strip, said method comprising the steps of:

imparting motion to said strips in said direction of conveyance;

separating in alternating strip fashion leading ones of said document from their respective strips;

determining whether the leading edges of documents in one of said strips are in an acceptable positional relationship in said direction of conveyance with said leading edges of documents in the other of said strips, said determining step further comprising the steps of:

determining when leading ones of said documents have been separated from their respective strips and for generating a separation signal indicative thereof;

using pulse generation means for generating timing pulses;

selectively enabling counting of said timing pulses by a first counter and a second counter, said counters being enabled in alternating fashion after documents are separated in alternating strip fashion from their rows, said counters being enabled to count the number of pulses generated from a point in time after a preceding document has been separated from a first of said strips until a document has been separated from a second of said strips; and, comparing the count in one of said counters (indicative of the number of timing pulses generated with respect to the conveyance of a just-separated from said second strip document) with the count in the other of said counters (indicative of the number of timing pulses generated with respect to the conveyance of the document previously separated from said first strip) and for generating a comparison signal indicative thereof;

using braking means capable of at least temporarily retarding the motion of at least one of said strips; and, controlling said braking means whereby the motion of at least one of said strips is retarded for urging the leading edges of documents in one of said strips into said acceptable positional relationship in said direction of conveyance with the leading edges of documents in the other of said strips.

22. The method of claim 21, wherein said step of determining when leading ones of said documents have been separated from their respective strips comprises detecting when leading edges and trailing edges of separated documents are conveyed past detection means.

23. The method of claim 22, wherein said point in time whereat said counters are enabled to count is the time whereat said detection means detects the trailing edge of the preceding separated document and the time whereat said counters are disabled is the time whereat the leading edge of a just-separated document is detected by said detection means.

24. The method of claim 22, wherein said control means deenergizes said braking means for a time period extending from the time whereat said detection means detects the leading edge of a just-separated document to the time whereat said detection means detects the trailing edge of said just-separated document, thereby precluding uneven wear of said braking means.

25. The method of claim 21, wherein said control means periodically deenergizes said braking means, thereby precluding uneven wear of said braking means.

26. A method for conveying at least two superposed strips of documents in a direction of conveyance toward a downstream workstation, each of said strips comprising a plurality of documents, each of said documents having a portion thereof which will be a leading edge upon eventual separation of said document from its strip, said strips being conveyed over one another in a direction of superposition whereby the leading edges of documents of one strip alternate in sequence in the direction of conveyance with the leading edge of documents in another strip, said method comprising the steps of:

imparting motion to said strips in said direction of conveyance;

separating in alternating strip fashion leading ones of said document from their respective strips;

determining whether the speeds of motion of said strips are in an acceptable velocity relationship, said determining step further comprising the steps of:

determining when leading ones of said documents have been separated from their respective strips and for generating a separation signal indicative thereof;

using pulse generation means for generating time pulses;

selectively enabling counting of said timing pulses by a first counter and a second counter, said counters being enabled in alternating fashion after documents are separated in alternating strip fashion from their rows, said counters being enabled to count the number of pulses generated from a point in time after a preceding document has been separated from a first of said strips until a document has been separated from a second of said strips; and, comparing the count in one of said counters (indicative of the number of timing pulses generated with respect to the conveyance of a just-separated from said second strip document) with the count in the other of said counters (indicative of the number of timing pulses generated with respect to the conveyance of the document previously separated from said first strip) and for generating a comparison signal indicative thereof;

using braking means capable of at least temporarily retarding the motion of at least one of said strips; and, controlling said braking means whereby the motion of at least one of said strips is retarded for restoring said acceptable velocity relationship of said strips.

27. The method of claim 26, wherein said step of determining when leading ones of said documents have been separated from their respective strips comprises detecting when leading edges and trailing edges of separated documents are conveyed past detection means.

28. The method of claim 26, wherein said point in time whereat said counters are enabled to count is the time whereat said detection means detects the trailing edge of the preceding separated document and the time whereat said counters are disabled is the time whereat the leading edge of a just-separated document is detected by said detection means.

29. The method of claim 27, wherein said control means deenergizes said braking means for a time period extending from the time whereat said detection means detects the leading edge of a just-separated document to the time whereat said detection means detects the trailing edge of said just-separated document, thereby precluding uneven wear of said braking means.

30. The method of claim 26, wherein said control means periodically deenergizes said braking means, thereby precluding uneven wear of said braking means.

* * * * *